US007325425B1

(12) United States Patent
Miller

(10) Patent No.: US 7,325,425 B1
(45) Date of Patent: Feb. 5, 2008

(54) COMBINED PADLOCK HOUSING AND ACOUSTIC NOTIFICATION DEVICE

(76) Inventor: Joseph F. Miller, 1225 Palacio Dr., Phoenix, AZ (US) 85014

( * ) Notice: Subject to any disclaimer, the term of this patent is extended or adjusted under 35 U.S.C. 154(b) by 0 days.

(21) Appl. No.: 11/256,486

(22) Filed: Oct. 24, 2005

(51) Int. Cl.
*E05B 67/02* (2006.01)
*G08B 13/00* (2006.01)

(52) U.S. Cl. ..... 70/52; 340/541

(58) Field of Classification Search ..... 70/52, 70/432–441, 20–49, 54–56, DIG. 49, DIG. 30; 340/542
See application file for complete search history.

(56) References Cited

U.S. PATENT DOCUMENTS 3,789,639 A 2/1974 Canter
4,556,872 A 12/1985 Masoncup et al.
4,558,193 A * 12/1985 Test ..... 200/43.08
D326,600 S 6/1992 Heald
5,404,735 A * 4/1995 Hsieh ..... 70/38 A
5,406,257 A * 4/1995 Saito ..... 340/542
5,412,963 A * 5/1995 Carlo et al. ..... 70/209
5,546,776 A * 8/1996 Sun et al. ..... 70/233
5,678,434 A * 10/1997 Kuo et al. ..... 70/209
5,680,094 A 10/1997 Guim et al.
5,864,528 A * 1/1999 Ikeda et al. ..... 369/53.21
6,043,733 A * 3/2000 Lind ..... 340/426.28
6,100,802 A * 8/2000 Adams ..... 340/542
6,442,983 B1 9/2002 Thomas et al.
6,446,475 B1 * 9/2002 Agnatovech et al. ..... 70/379 R
6,467,316 B1 10/2002 Chen
2005/0199019 A1 * 9/2005 Marcelle et al. ..... 70/38 A

* cited by examiner

*Primary Examiner*—Jennifer H. Gay
*Assistant Examiner*—Kristina R Gluchowski

(57) ABSTRACT

The padlock housing assembly includes a padlock housing having monolithically formed walls for cradling an existing padlock therein. A top one of the walls is provided with an annular aperture for receiving a U-shaped shank of an existing padlock therethrough. The shank maintains a static relationship with the padlock housing when the shank is passed through the aperture and engaged with the existing padlock to a closed position. An audio mechanism is included for playing an audio file when the shank is biased to an open position and is housed within the cavity. At least one LED is also provided for emitting a predetermined luminescence when the shaft is biased to the open position. A trigger mechanism transmits a power input signal to the audio mechanism when the shank is biased to the open position. The triggering mechanism is operably engaged with the shank.

4 Claims, 4 Drawing Sheets

FIG. 4
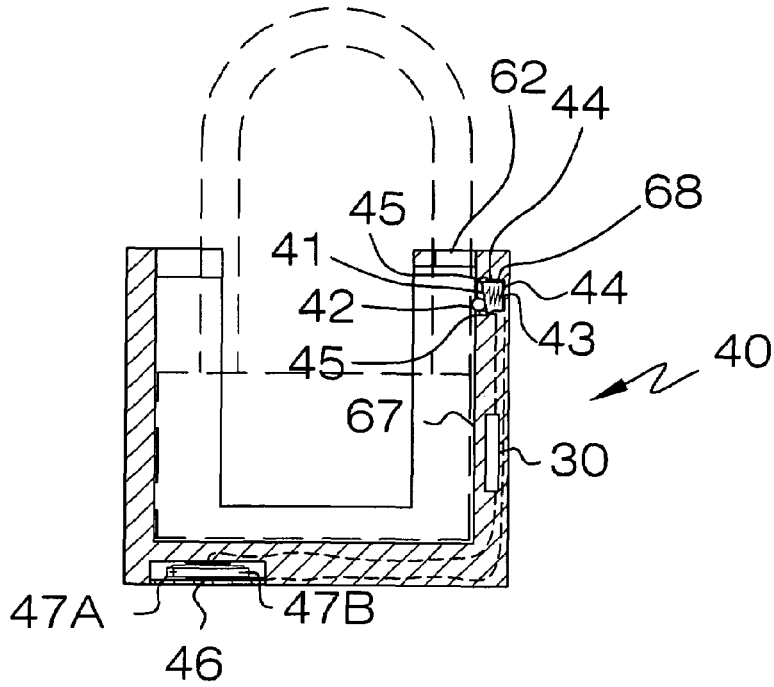
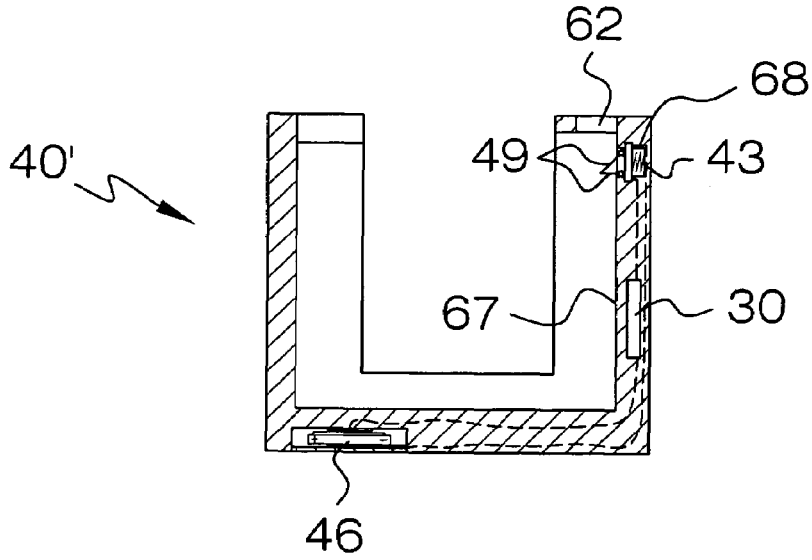
FIG. 7

COMBINED PADLOCK HOUSING AND ACOUSTIC NOTIFICATION DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to padlock housings and, more particularly, to a combined padlock housing and acoustic notification device for providing audible and visual warning signals when a padlock is biased to an open position.

2. Prior Art

Generally, a padlock comprises a body and a shackle having a pair of legs. The shackle is mounted for reciprocal movement relative to the body between a closed first position and an open second position. Located within the body is a latch for engaging one leg of the shackle when the shackle is in its closed position, preventing movement of the shackle to its open position. In order to move the shackle from its closed to its open position, the latch must be disengaged, and the padlock includes a lock mechanism operable to disengage the latch. The lock mechanism may be key operated or combination-operated in an authorized manner. The padlock is typically composed of a hard metal such as steel.

Padlocks are used for securing possessions or property to prevent theft or trespassing. It is not uncommon, however, for someone intent on theft or trespassing to tamper with the padlock in an attempt to open it in an unauthorized manner, either by severing the shackle or by forcing it into an open position. In other instances, the owner of the padlock opens the lock, but subsequently forgets to lock it. This may also lead to theft of, or tampering with, the property that the lock is intended to protect. To deter a thief or the like from tampering with the padlock, or to remind an owner of an open lock, it has been proposed to provide the padlock with an integral alarm system which sounds an alarm when the padlock is opened.

Accordingly, a need remains for a combined padlock housing and acoustic notification device in order to overcome the above-noted shortcomings. The present invention satisfies such a need by providing a combined padlock housing and acoustic playback assembly that is convenient and easy to use, compact in size, reasonably priced, and grants improved protection of one's valuables. Such a padlock housing assembly is especially helpful to homeowners and school children, whom employ padlocks on a regular basis, by preventing them from inadvertently leaving a padlock open.

BRIEF SUMMARY OF THE INVENTION

In view of the foregoing background, it is therefore an object of the present invention to provide a combined padlock housing and acoustic notification device. These and other objects, features, and advantages of the invention are provided by a padlock housing assembly for providing audible and visual warning signals when the padlock is biased to an open position.

The present invention includes a padlock housing having a plurality of monolithically formed walls sized and shaped for defining a generally rectangular cavity for cradling an existing padlock therein. The padlock housing is preferably formed from hardened material such as steel or reinforced plastic, for example. A top one of the walls is provided with an annular aperture for receiving a U-shaped shank of an existing padlock therethrough. Front and rear ones of the walls are provided with substantially U-shaped openings equidistantly registered with a centrally aligned vertical axis passing through the padlock housing.

Another one of the walls is provided with a notch formed therein. Such a notch is situated subjacent the aperture such that the shank slidably adjoins the notch when interfitted through the aperture. The shank maintains a static relationship with the padlock housing when the shank is passed through the aperture and engaged with the existing padlock to a closed position. The shank is exposed above the padlock housing during operating conditions for allowing the user to readily access the shank during closed positions.

Notably, audio mechanism for playing an audio file when the shank is biased to an open position is also provided. The audio mechanism is housed within the padlock housing in such a manner that the operator cannot tamper or alter the audio mechanism without dismantling the padlock housing walls. The audio mechanism is uploaded with a predetermined quantity of audio files which can be downloaded and transferred to a portable electronic device via conventional communication links such as a USB cord or flash memory device, for example. A visual notification emitter is also provided for illuminating a predetermined lumen rating when the shank is biased to the open position. Such an emitter preferably includes a conventional LED provided with an associated power driver for regulating voltage input transferred thereto. The driver may generate a sequential and oscillating voltage input for the LED such that the LED is caused to blink, for example. Alternately, the driver may provide a continuous voltage input to the LED for causing the LED to provide a steady luminescence when the shaft is biased to the open position.

Trigger mechanism is provided for selectively transmitting a power input signal to the audio mechanism when the shank is biased to an open position. Such a trigger mechanism cooperates with the audio mechanism such that the audio file will be automatically discontinued when the shank is biased to the closed position. Discontinued is defined as stopping or pausing the audio file during normal playing conditions. In particular, the trigger mechanism generates and sends the power input signal to the audio mechanism for instructing the audio mechanism to generate and transmit an output signal associated with a predetermined one of the audio files.

In a preferred embodiment, the audio mechanism includes a signal interface circuit receiving the power input signal. Such an interface circuit is electrically and directly coupled to the trigger mechanism. The audio mechanism further includes an audio play-back device and a memory electrically coupled thereto. The audio play-back device is electrically and directly coupled to the signal interface circuit wherein the power input signal instructs the audio play-back device to access and play the one audio file. A speaker is electrically and directly coupled an amplifier and the amplifier is directly coupled to the audio play-back device. The amplifier receives the output signal and increases a voltage level associated with the output signal such that the audio file can be played back at a sufficient volume for notifying the operator that the existing padlock is biased to the open position.

In a preferred embodiment, the trigger mechanism includes an actuator arm offset from a vertical axis and within the notch, and a ball-bearing operably and directly engaged with the actuator arm wherein the ball bearing is intercalated between the actuator arm and a vertical travel path of the shank such that the ball bearing maintains continuous contact with the shank when the shank is funneled through the aperture and biased to the closed position. The trigger mechanism further includes a deformably resilient spring member having a longitudinal axis aligned orthogonal to the vertical axis wherein the spring member has opposed end portions conjoined to the actuator arm and laterally disposed away therefrom.

A plurality of electrically conductive contacts are selectively engageable with the actuator arm when the shank is removed from the aperture and thereby disengaged from the ball bearing. An internal power supply source has positive and negative terminals electrically mated to the audio mechanism and electrically mateable with the contacts for closing a conductive path when the shank is removed from the aperture to thereby power the audio device. Notably, the spring member is compressible along a horizontal axis for allowing the shank to freely slide along the vertical axis.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 4 is a cross-sectional view showing a preferred embodiment of a trigger mechanism housed within the padlock housing;

FIG. 7 is a cross-sectional view showing an alternate embodiment of the trigger mechanism shown in FIG. 4.

DETAILED DESCRIPTION OF THE INVENTION

Figure 1:
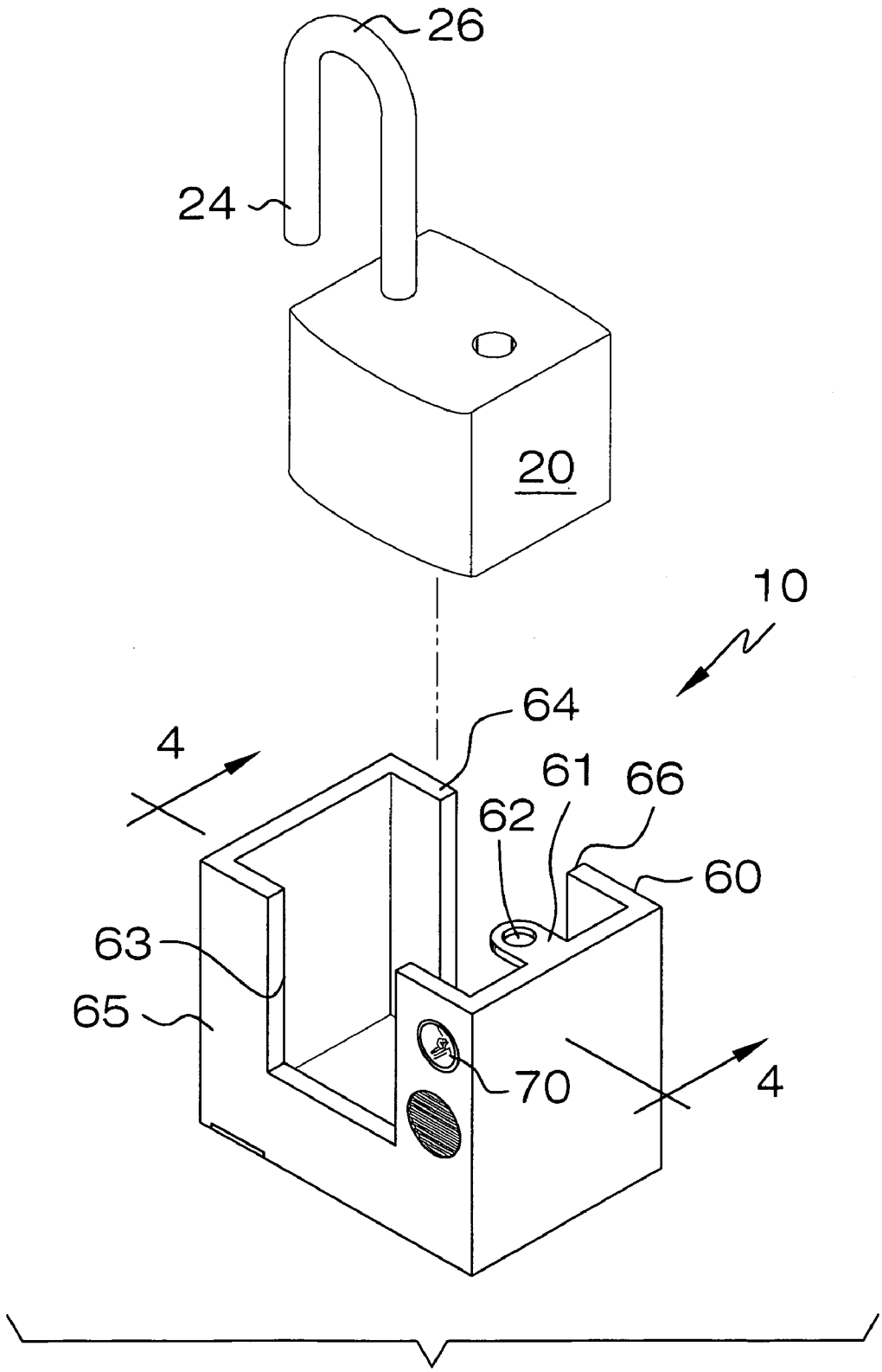
FIG. 1 is a perspective view showing the padlock housing and an existing padlock, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures. Prime and double notations refer to alternate embodiments of like elements.

The device of this invention is referred to generally in FIGS. 1-7 by the reference numeral 10 and is intended to provide a combined padlock housing and acoustic notification assembly. It should be understood that the assembly 10 may be employed with various padlocks and, therefore, should not be construed as having limited use with any one particular padlock available on the market.

Initially referring to FIG. 1, the assembly 10 includes a padlock housing 60 having a plurality of monolithically formed walls sized and shaped for defining a generally rectangular cavity for cradling an existing padlock 20 therein. The padlock housing 60 is preferably formed from hardened material such as steel or reinforced plastic, for example. A top one of the walls 61 is provided with an annular aperture 62 for receiving a U-shaped shank 24 of the existing padlock therethrough. The location of the aperture 62 is essential for allowing the shank 24 to operably engage and disengage the trigger mechanism 40 (described hereinbelow). Front and rear ones of the walls 63, 64 are provided with substantially U-shaped openings 65, 66 equidistantly registered with a centrally aligned vertical axis passing through the padlock housing 60.

Figure 2:
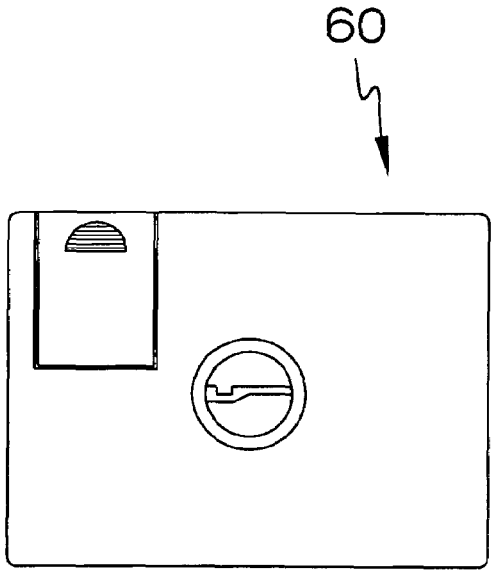
FIG. 2 is a bottom plan view of the padlock housing shown in FIG. 1, wherein the existing padlock is nested within the padlock housing.
Figure 3:
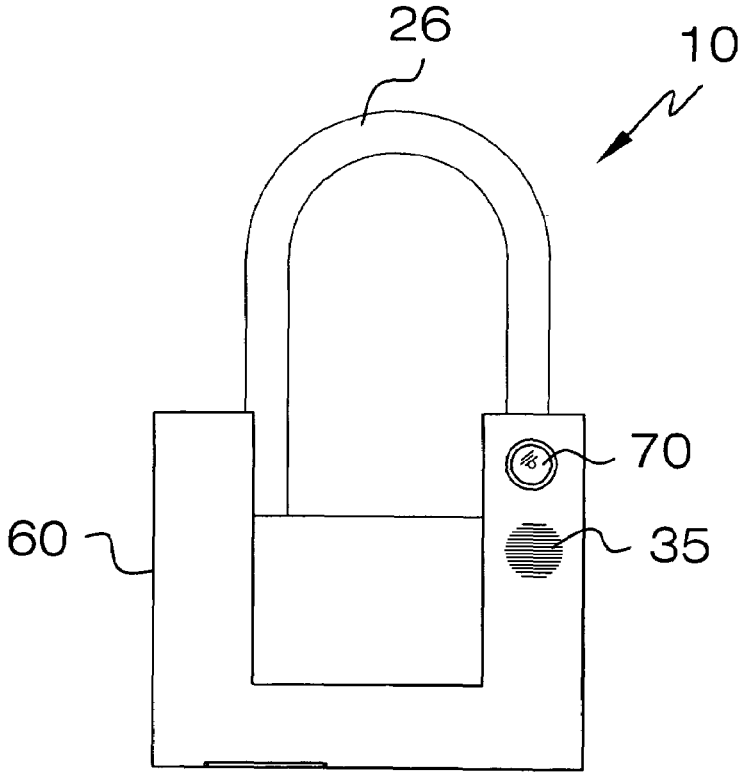
FIG. 3 is a front-elevational view of the padlock housing shown in FIG. 2.

Referring to FIGS. 4 and 7, another one of the walls 67 is provided with notch 68 formed in an interior surface thereof such that the notch 68 is neither visible nor accessible while the padlock 20 is seated within the padlock housing 60. Notch 68 is situated subjacent aperture 62 such that the shank 24 slidably adjoins notch 68 when interfitted through aperture 62. The shank 24 maintains a static relationship with the padlock housing 60 when the shank 24 is passed through aperture 62 and securely adapted to a closed position. The shank 24 has a centrally aligned apex 26 exposed above the padlock housing 60 during operating conditions for allowing the user to readily access the shank 24 during closed positions, as perhaps best shown in FIG. 3. Of course, the shank 24 may be alternately shaped for various other applications, as is obvious to a person of ordinary skill in the art. Referring to FIG. 2, the existing padlock 20 may employ a variety of locking mechanisms such as a key lock type or alphanumerical combination locking type, as is obvious to a person of ordinary skill in the art.

Figure 5:
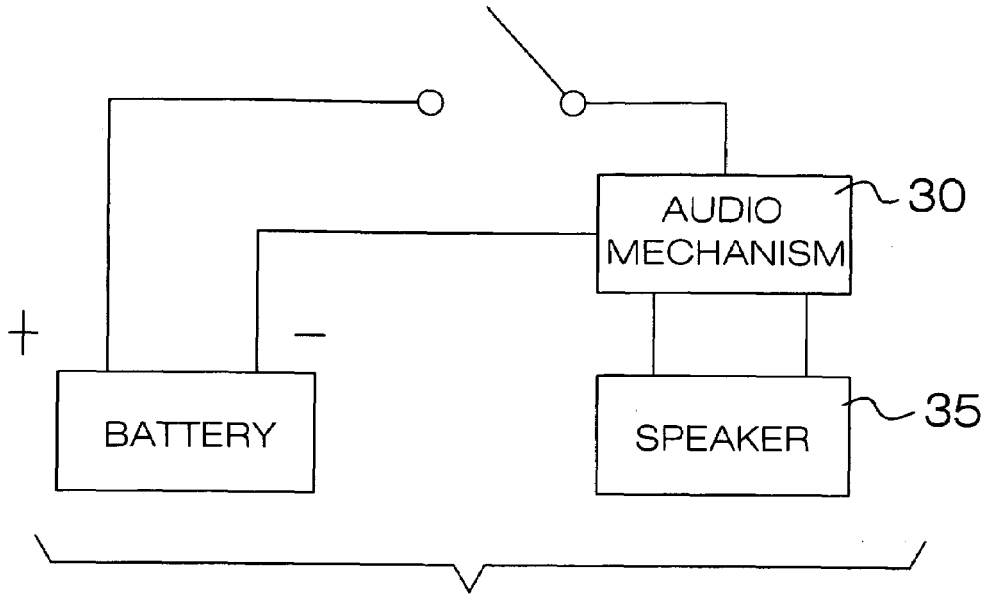
FIG. 5 is a schematic block diagram view showing the audio mechanism electrically mated to a speaker and a trigger mechanism, in accordance with the present invention.
Figure 6:
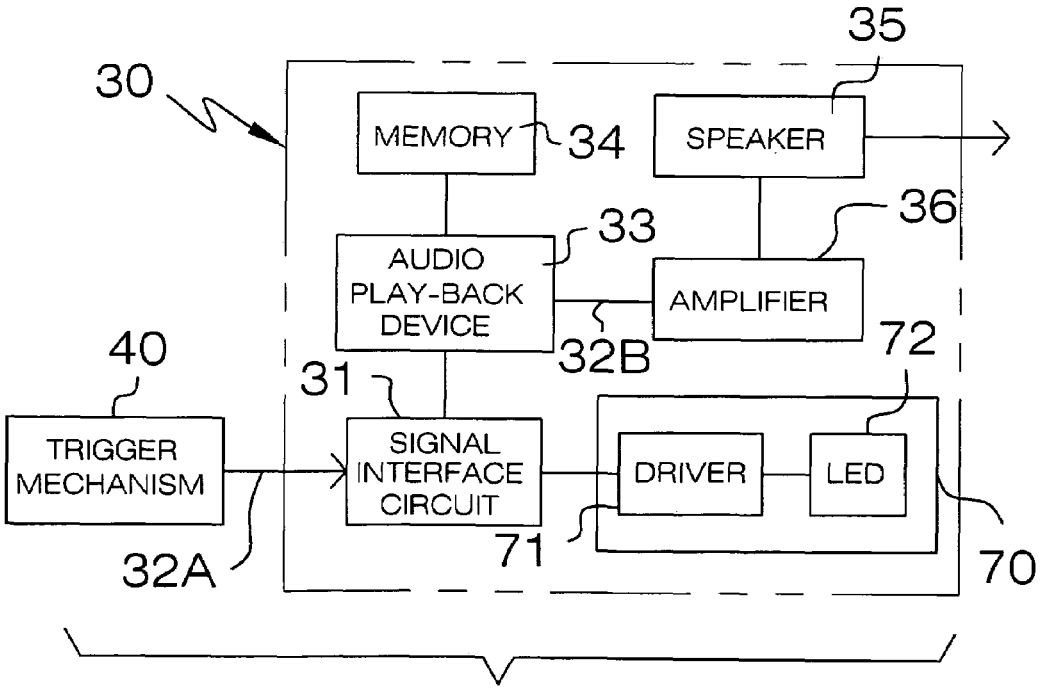
FIG. 6 is a schematic block diagram showing the interrelationship of the audio mechanism's primary components.

Referring to FIGS. 5 and 6, an audio mechanism 30 for playing an audio file when the shank 24 is biased to an open position is also provided. Such an audio mechanism 30 is housed within the cavity 22 in such a manner that the operator, or another party, cannot tamper or alter the audio mechanism 30 without dismantling the housing walls 61, 63, 64 and 67. The audio mechanism 30 houses a predetermined quantity of audio files that are acoustically suitable for notifying an owner that shank 24 of padlock 20 is at an open position. The audio mechanism 30 is uploaded with a predetermined quantity of audio files which can be downloaded and transferred to a portable electronic device via conventional communication links such as a USB cord or flash memory device, for example. Of course, the audio files may be stored in a variety of formats including digitally recorded files in MP3 format, for example, as well known to a person of ordinary skill in the art.

Still referring to FIGS. 5 and 6, the audio mechanism 30 includes a signal interface circuit 31 that is important for receiving the power input signal 32A. Such an interface circuit 31 is electrically and directly coupled to the trigger mechanism 40 (described herein below). An audio play-back device 33 and a memory 34 are electrically coupled thereto. Such an audio play-back device 33 is electrically and directly coupled to the signal interface circuit 31, wherein the power input signal 32A is critical for instructing the audio play-back device 33 to access and play one audio file. A speaker 35 and an amplifier 36 are electrically and directly coupled with no intervening elements thereto. Such an amplifier 36 is further directly coupled with no intervening elements to the audio play-back device 33.

As perhaps best shown in FIGS. 1 and 6, a visual notification emitter 70 is also provided for generating a predetermined lumen rating when the shank 24 is biased to the open position. Such an emitter 70 preferably includes a conventional LED 72 provided with an associated power driver 71 for regulating voltage input transferred thereto. The driver 71 may generate a sequential and oscillating voltage input for the LED 72 such that the LED 72 is caused to blink, for example. Alternately, the driver 71 may provide a continuous voltage input to the LED 72 for causing the LED 72 to provide a steady luminescence when the shaft 24 is biased to the open position wherein the voltage input is eliminated when the shaft 24 is adapted to the closed position.

The amplifier 36 receives the output signal 32B and increases a voltage level associated with the output signal 32B such that the audio file can effectively be played back at a sufficient volume for advantageously notifying the operator that the padlock 20 is biased at the open position. Of course, the audio play-back device 33 and the memory 34 may be substituted with a piezoelectric transducer (not shown) for audibly notifying a user of an open padlock 20, as is obvious to a person of ordinary skill in the art.

Referring to FIGS. 4 and 7, alternate embodiments of trigger mechanism 40, 40' are shown. In such embodiments, trigger mechanisms 40, 40' selectively transmit a power input signal 32A to the audio mechanism 30 when shank 24 is biased to the open position. Such trigger mechanisms 40, 40' cooperate with the audio mechanism 30 such that the audio file can effectively be automatically discontinued when shank 24 is biased to a closed position. The triggering mechanisms 40, 40' are directly and operably engaged with shank 24, which is vital for ensuring that the power input signal 32A is only sent when shank 24 is biased to the open position.

In operation, trigger mechanisms 40, 40' generate and send the power input signal 32A to the audio mechanism 30 for instructing the audio mechanism 30 to generate and transmit an output signal 32B associated with a predetermined one of the audio files.

Referring to FIG. 4 in more detail, trigger mechanism 40 includes an actuator arm 41 offset from the vertical axis and situated adjacent to shank 24 and notch 68. A ball-bearing 42 is operably engageable with the actuator arm 41 wherein the ball bearing 42 is intercalated between the actuator arm 41 and shank 24 such that the ball bearing 42 effectively maintains continuous surface area contact with shank 24 when shank 24 is biased to the closed position.

A deformably resilient spring member 43 has a longitudinal axis aligned orthogonal to the vertical axis wherein the spring member 43 further has opposed end portions 44 conjoined to the actuator arm 41 and laterally disposed away therefrom. Such a first spring member 43 is seated within notch 68 and operably compressible along a horizontal axis, which is critical for closing an electric circuit when shank 24 is biased to an open position, so that a selected audio file can advantageously be played and notify the padlock owner that the padlock 20 is unlocked.

Still referring to FIG. 4, a plurality of electrically conductive contacts 45 are engageable with the actuator arm 41 when the shank 24 is removed from notch 68. An internal power supply source 46 has positive 47A and negative 47B terminals electrically mated to the audio mechanism 30 and electrically mateable with the contacts 44 for closing a conductive path when the shank 24 is removed from aperture 62 thereby effectively powering the audio play-back device 33.

Referring to FIG. 7, an alternate embodiment 40' of trigger mechanism 40 is shown wherein ball bearing 42 and actuating arm 41 are replaced with a pair of conductive elements 49 resiliently adaptable to engage each other when shank 24 is positioned through notch 68, and thereby close the circuit for powering audio mechanism 30.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A padlock housing assembly for providing an audible warning signal when a padlock is biased to an open position, said padlock housing assembly comprising:

a padlock housing having a plurality of monolithically formed walls sized and shaped for defining a rectangular cavity for cradling an existing padlock therein, a top one of said walls being provided with an annular aperture for receiving a U-shaped shank of an existing padlock therethrough, front and rear ones of said walls being provided with substantially U-shaped openings equidistantly registered with a centrally aligned vertical axis passing through said padlock housing, another one of said walls being provided with a notch formed therein and situated subjacent said aperture such that the shank slidably adjoins said notch when interfitted through said aperture, said shank maintaining a static relationship with said padlock housing when said shank is passed through said aperture and engaged with the existing padlock to a closed position, said shank being exposed above said padlock housing during operating conditions;

audio means for playing an audio file when the shank is biased to an open position, said audio means being housed within said padlock housing in such a manner that the operator cannot tamper or alter said audio means without dismantling said padlock housing walls, said audio means housing a predetermined quantity of audio files; and trigger means for selectively transmitting a power input signal to said audio means when said shank is biased to an open position, said trigger means cooperating with said audio means such that the audio file will be automatically discontinued when said shank is biased to the closed position;

wherein said trigger means generates and sends said power input signal to said audio means for instructing said audio means to generate and transmit an output signal associated with a predetermined one of said audio files;

wherein said trigger means comprises an actuator arm offset from a vertical axis and disposed within said notch, said actuator arm having top and bottom ends directly abutted against top and bottom walls of said notch respectively, a ball-bearing operably and directly engaged with said actuator arm wherein said ball bearing is intercalated between said actuator arm and a vertical travel path of the shank such that said ball bearing maintains continuous contact with the shank when the shank is funneled through said aperture and biased to the closed position, a deformably resilient spring member having a longitudinal axis aligned orthogonal to the vertical axis wherein said spring member has opposed end portions conjoined to said actuator arm and laterally disposed away therefrom, said ball bearing being spaced from said spring member, a plurality of electrically conductive contacts engageable with said actuator arm when the shank is removed from said aperture and thereby disengaged from said ball bearing, and an internal power supply source having positive and negative terminals electrically mated directly to said audio means and electrically mateable directly with said contacts for closing a conductive path when the shank is removed from said aperture to thereby power said audio device;

wherein said audio means comprises a signal interface circuit receiving said power input signal, said interface circuit being electrically and directly coupled to said trigger means;

an audio play-back device and a memory electrically coupled thereto, said audio play-back device being electrically and directly coupled to said signal interface circuit wherein said power input signal instructs said audio play-back device to access and play said one audio file; and a speaker and an amplifier electrically and directly coupled thereto, said amplifier further being directly coupled to said audio play-back device, said amplifier receiving said output signal and increasing a voltage level associated with said output signal such that said one audio file can be played back at a sufficient volume for notifying the operator that the existing padlock is biased to the open position.

2. The padlock assembly of claim 1, wherein said spring member is compressible along a horizontal axis.

3. A padlock housing assembly for providing an audible warning signal when a padlock is biased to an open position, said padlock housing assembly comprising:

a padlock housing having a plurality of monolithically formed walls sized and shaped for defining a generally rectangular cavity for cradling an existing padlock therein, a top one said walls being provided with an annular aperture for receiving a U-shaped shank of an existing padlock therethrough, front and rear ones of said walls being provided with substantially U-shaped openings equidistantly registered with a centrally aligned vertical axis passing through said padlock housing, another one of said wall being provided with notch formed therein and situated subjacent said aperture such that the shank slidably adjoins said notch when interfitted through said aperture, said shank maintaining a static relationship with said padlock housing when said shank is passed through said aperture and engaged with the existing padlock to a closed position, said shank being exposed above said padlock housing during operating conditions, said padlock housing being formed from rigid and hardened material;

audio means for playing an audio file when the shank is biased to an open position, said audio means being housed within said padlock housing in such a manner that the operator cannot tamper or alter said audio means without dismantling said padlock housing walls, said audio means housing a predetermined quantity of audio files; and trigger means for selectively transmitting a power input signal to said audio means when said shank is biased to an open position, said trigger means cooperating with said audio means such that the audio file will be automatically discontinued when said shank is biased to the closed position;

wherein said trigger means generates and sends said power input signal to said audio means for instructing said audio means to generate and transmit an output signal associated with a predetermined one of said audio files;

wherein said audio means comprises:

a signal interface circuit receiving said power input signal, said interface circuit being electrically and directly coupled to said trigger means;

an audio play-back device and a memory electrically coupled thereto, said audio play-back device being electrically and directly coupled to said signal interface circuit wherein said power input signal instructs said audio play-back device to access and play said one audio file; and a speaker and an amplifier electrically and directly coupled thereto, said amplifier further being directly coupled to said audio play-back device, said amplifier receiving said output signal and increasing a voltage level associated with said output signal such that said one audio file can be played back at a sufficient volume for notifying the operator that the existing padlock is biased to the open position;

wherein said trigger means comprises an actuator arm offset from a vertical axis and within said notch;

a ball-bearing operably and directly engaged with said actuator arm wherein said ball bearing is intercalated between said actuator arm and a vertical travel path of the shank such that said ball bearing maintains continuous contact with the shank when the shank is funneled through said aperture and biased to the closed position;

a deformably resilient spring member having a longitudinal axis aligned orthogonal to the vertical axis wherein said spring member has opposed end portions conjoined to said actuator arm and laterally disposed away therefrom;

a plurality of electrically conductive contacts engageable with said actuator arm when the shank is removed from said aperture and thereby disengaged from said ball bearing; and an internal power supply source having positive and negative terminals electrically mated to said audio means and electrically mateable with said contacts for closing a conductive path when the shank is removed from said aperture to thereby power said audio device.

4. The padlock assembly of claim 3, wherein said spring member is compressible along a horizontal axis.

* * * * *